US005272475A

United States Patent [19]

Eaton et al.

[11] Patent Number: 5,272,475

[45] Date of Patent: Dec. 21, 1993

[54] ALERTING SYSTEM FOR A COMMUNICATION RECEIVER

[75] Inventors: Eric T. Eaton, Lake Worth; Von A. Mock, Lantana; Matthew J. Stanislawski, Boynton Beach, all of Fla.

[73] Assignee: Motorola, Inc., Schaumburg, Ill.

[21] Appl. No.: 807,019

[22] Filed: Dec. 9, 1991

[51] Int. Cl.[5] ..... G08B 7/00

[52] U.S. Cl. ..... 340/825.44; 340/825.46; 340/311.1; 455/38.3; 320/3

[58] Field of Search ..... 340/825.44, 825.46, 340/333, 311.1; 455/38.3, 343, 89; 379/56, 57; 320/3, 4, 15, 19, 48; 307/18

[56] References Cited

U.S. PATENT DOCUMENTS

| | | | |
|---|---|---|---|
| 4,025,860 | 5/1977 | Shibata et al. | 320/3 |
| 4,352,091 | 9/1982 | Yamasaki | 340/311.1 |
| 4,383,257 | 5/1983 | Giallanza et al. | 340/825.44 |
| 4,422,178 | 12/1983 | Mori | 455/343 |
| 4,612,492 | 9/1986 | Burk | 320/3 |
| 4,851,756 | 7/1989 | Schaller et al. | 320/3 |
| 4,914,393 | 4/1990 | Yoshido | 324/428 |
| 5,115,182 | 5/1992 | Ehmke et al. | 455/89 |

*Primary Examiner*—Donald J. Yusko
*Assistant Examiner*—Edwin C. Holloway, III
*Attorney, Agent, or Firm*—Philip P. Macnak; Thomas G. Berry; Daniel R. Collopy

[57] ABSTRACT

An alerting system for a selective call communication receiver (10) which includes a battery (26A, 26B) for supplying energy at a first supply rate and a receiver (14) coupled thereto for receiving transmitted selective call message signals includes a decoder (16), a power source (44), an annunciator (34) and a charging circuit (36). The decoder (16) is coupled to the battery (26A, 26B) and decodes the received selective call message signals and generates an alert signal output in response to the received selective call message signals. The power source (44) is capable of being charged and supplies energy at a second supply rate. The annunciator (34) is coupled to the power source (44) and is responsive to the alert signal output for providing a sensible alert. The annunciator (34) consumes energy at the second supply rate when providing the sensible alert. The charging circuit (36) is coupled to the battery (26A, 26B) and is responsive to the sensible alert being generated for charging the power source (44) from the battery (26A, 26B) to replenish the energy consumed during the generation of the sensible alert.

20 Claims, 10 Drawing Sheets

ALERTING SYSTEM FOR A COMMUNICATION RECEIVER

BACKGROUND OF THE INVENTION

1. Field of the Invention

The present invention relates generally to the field of communication receivers, and more particularly to an alerting system which utilizes a rechargeable back-up battery.

2. Description of the Prior Art

Selective call communication receivers, such as pagers, have utilized a variety of alerting devices to provide an alerting function which is intended to alert the user when a message is received. The alerting devices utilized have included such devices as speakers and audio transducers to provide audible alerts, LED's to provide visual alerts, and vibrators to provide tactile alerts. Each of the alerting devices have different energy consumption requirements. LED's, for example, have generally required the least amount of energy, or power, to provide a visual alert. Speakers and audio transducers have generally required a greater amount of energy, the actual amount of energy required being determined by the device impedance and the volume, or sound pressure level (SPL) output required from the speaker or audio transducer. Vibrators, which have generally utilized motors to spin an unbalanced counterweight, have the highest energy requirements, significantly greater than either LED's and speakers or audio transducers.

Previous selective call receivers have often included one or more of the alerting devices to provide different alerts to meet different user needs. For example, audio transducers were regularly offered in selective call receivers with vibrators to provide an audible alert when such an alert was not annoying to others, and a vibrator, or "silent" alert when an alert would be annoying to others, or when privacy was desired.

More recently, advances in components and technology have enabled significant reductions in the size of the selective call receivers. However, as the size of the selective call receivers has diminished due to the improvements in components and technology, it has become significantly more difficult to provide both audible and tactile alerting functions. This is especially true for such selective call receiver design formats as the "wrist watch" and "credit card" pager formats. As the size of the selective call receiver has come down, so too has the size of the battery had to be reduced in order to fit into the smaller receiver design formats. In order to maintain reasonable battery life in such receivers, newer battery technologies have had to be utilized, such as those provided by zinc-air and lithium battery technologies. However, the newer battery technologies, while improving the battery life for selective call receivers using visual or audible alerts, are generally incapable of supplying the necessary power to drive a vibrator, due to the significantly higher internal cell impedances. Consequently, there is a need to provide a way to utilize a vibrator in the small selective call receiver design formats which do not unduly impact the size of the receiver, and which do not compromise the use of the higher energy content zinc-air and lithium battery technologies.

SUMMARY OF THE INVENTION

In accordance with one aspect of the present invention, an alerting system for a communication receiver which includes a battery for supplying energy at a first supply rate to a receiver coupled thereto for receiving transmitted selective call message signals comprises a decoder means, a power source, an annunciator means and a charging means. The decoder means is coupled to the battery and decodes the received selective call message signals and generates an alert signal output in response thereto. The power source is capable of being charged and supplies energy at a second supply rate. The annunciator means is coupled to the power source and is responsive to the alert signal output for providing a sensible alert. The annunciator means consumes energy at the second supply rate when providing the sensible alert. The charging means is coupled to the battery and is responsive to the sensible alert being generated for charging the power source from the battery to replenish the energy consumed during the generation of the sensible alert.

In accordance with another aspect of the present invention, a communication receiver comprises a battery, a receiver, a decoder means, a power source, an annunciator means, and a charging means. The battery supplies energy at a first supply rate to the receiver which receives the transmitted selective call message signals. The decoder means is coupled to the battery and decodes the received selective call message signals and generates an alert signal output in response thereto. The power source is capable of being charged and supplies energy at a second supply rate. The annunciator means is coupled to the power source and is responsive to the alert signal output for providing a sensible alert. The annunciator means consumes energy at the second supply rate when providing the sensible alert. The charging means is coupled to the battery and is responsive to the sensible alert being generated for charging the power source from the battery to replenish the energy consumed during the generation of the sensible alert.

DESCRIPTION OF THE PREFERRED EMBODIMENTS

Figure 1A:
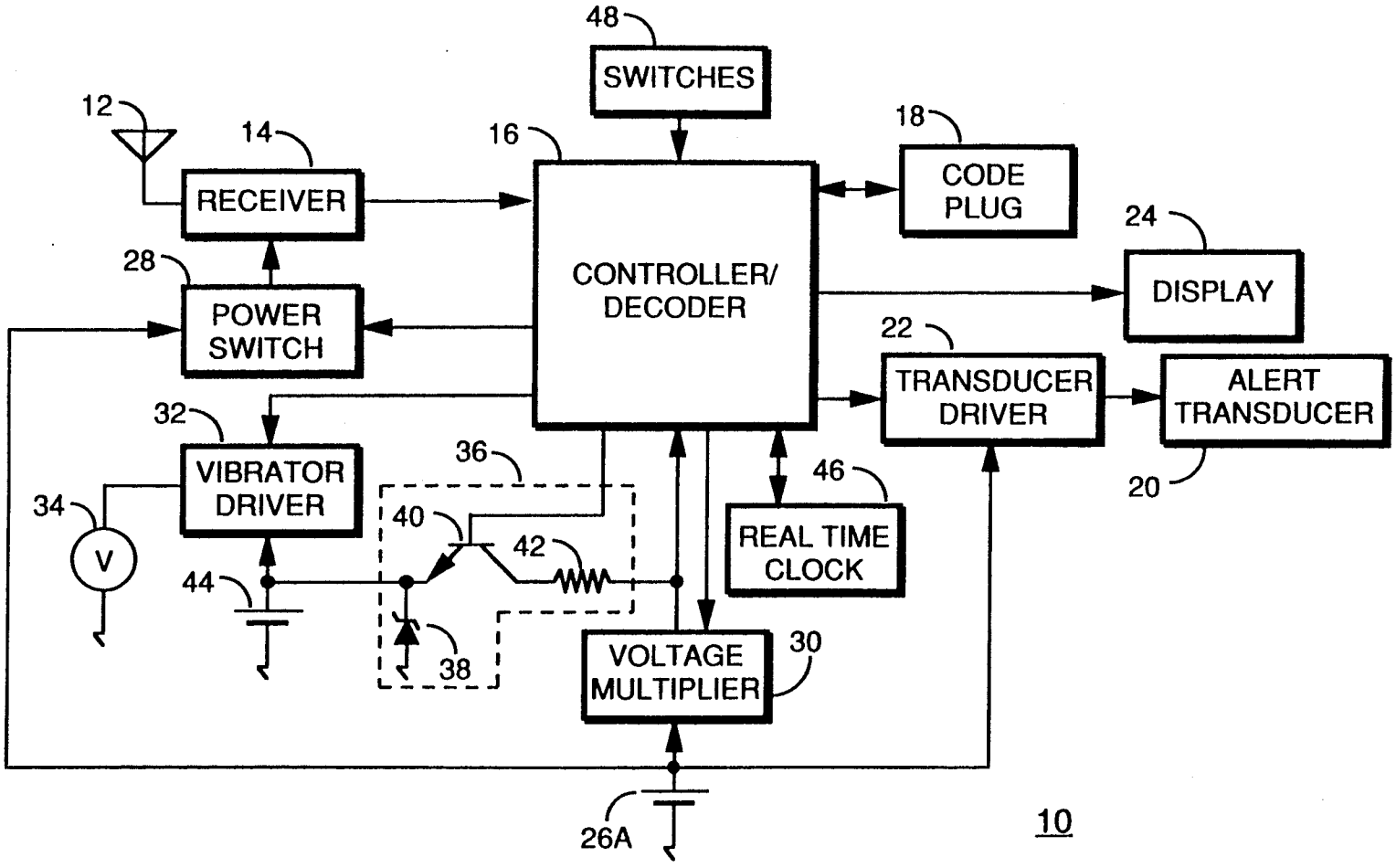
FIGS. 1A and 1B are electrical block diagrams of selective call receivers utilizing the alerting system in accordance with the preferred embodiment of the present invention.
Figure 1B:
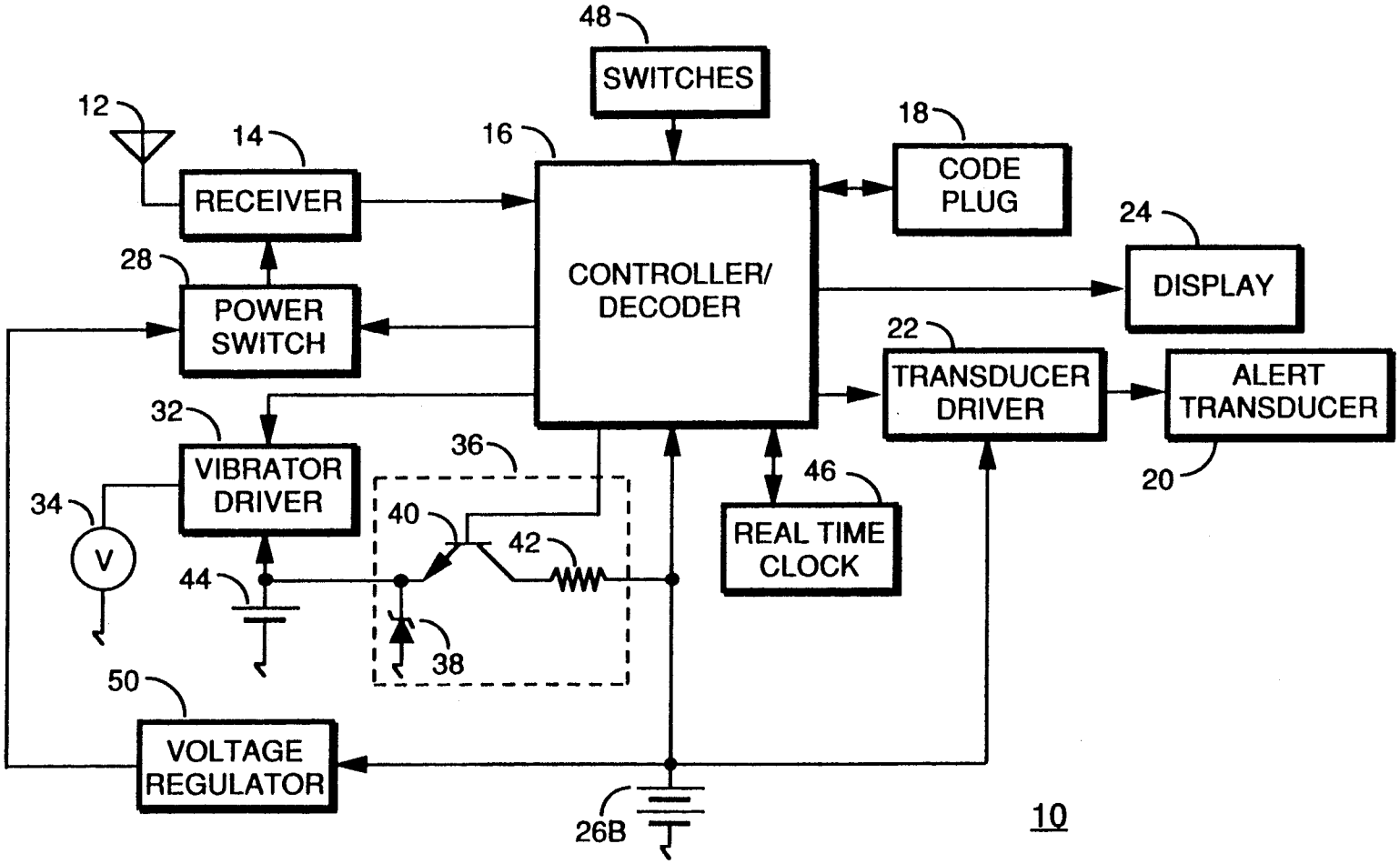

Referring to the drawings, FIGS. 1A and 1B are electrical block diagrams of selective call receivers utilizing the alerting system in accordance with the preferred embodiment of the present invention. In particular, referring to FIG. 1A, transmitted selective call message signals are intercepted by antenna 12 which couples the received signals to the input of a receiver 14. The selective call message signals are preferably paging signals which provide a receiver address and an associated message, such as a numeric or alphanumeric message, although it will be appreciated that other paging signaling formats, such as those providing tone only signaling, or tone and voice signaling would be suitable for use as well. The receiver 14 processes the received selective call message signals and produces at the output a data stream representative of the demodulated address and message information. The demodulated address and message information is coupled to the input of controller/decoder 16 which processes the information in a manner well known in the art depending upon the particular signaling format utilized. For purposes of illustration, it will be assumed that the POCSAG signaling format is utilized which is well known in the art, although any other signaling format could be utilized as well. When the address is received by decoder 16, the received address is compared in a manner well known in the art with the one or more addresses stored in the code plug, or code memory, 18, and when a match is detected an alert enable signal is generated. In one instance, the alert enable signal generated is outputted to the transducer driver 22 which processes the signal, and which is then coupled to the alert transducer 20 to produce an audible alert, alerting the user that a selective call message, or page, has been received. Message information, which is subsequently received, is stored in a memory (not shown), and can be recalled by the user for display, using one or more of the switches 48 which provide such functions as reset, read, hold, etc. A real time clock 46 is provided which can provide timing signals for the operation of the controller/decoder as will be described below, and which can also be utilized to time-stamp the received message. When a received message is time stamped, the time of reception is recovered and stored in the memory together with the received message. The recalled message information is recovered from the memory and outputted by the decoder/controller 16 to the display 24, thereby enabling the user to view the message, and when the message has been time-stamped, the time of reception can also be recovered and displayed with the message as well.

In addition to producing an audible alert, the selective call receiver in accordance with the preferred embodiment of the present invention also provides a user selectable sensible alert, such as a tactile alert, which delivers a "silent" alert when the user wishes to keep the message reception private, or when the user does not desire to disturb other persons in the immediate vicinity. The "silent" alert is selected by the user using one of the switches 48 provided therefor. When the "silent" alert is selected, the alert enable signal normally activating the audible transducer, is routed to the input of the vibrator driver 32 which processes the signal in a manner suitable for driving a vibrator 34.

A battery 26A is coupled to the transducer driver to provide the energy required to drive the alert transducer 20, and to a power switch 28. A second input to the power switch 28 is coupled to the decoder/controller 16, and an output is coupled to the receiver 14. The power switch 28 controls the supply of power from the battery 26A to the receiver 14 to enable the battery saving function which is well known in the art. The battery 26A is also coupled to the input of a voltage multiplier 30 which is utilized to step up the battery terminal voltage to a level suitable for use by the decoder/controller 16. When the decoder/controller 16 is constructed using a microcomputer, as will be described below, the voltage multiplier 30 generally at least doubles the battery terminal voltage. A second input is provided to the voltage multiplier from the controller/decoder 16 which is utilized to control the operation of the voltage multiplier, thereby providing an additional battery saving function in a manner well known in the art.

In prior art receiver designs, the battery 26A is also coupled to the vibrator driver 32 to provide the energy required to drive the vibrator 34. However, unlike the audible alert, which consumes a relatively small amount of energy from the battery 26A, the vibrator 34 can consume substantially large amounts of energy, in some instances, as much as an order of magnitude more energy than required for the audible alert. While such energy consumption levels are inconsequential in most battery systems, such as those using AAA-cell size and larger batteries, the smaller button cell batteries which are widely used in such devices as wristwatch and credit card form factor devices such as pagers, are generally incapable of providing the high currents required to power the vibrator 34 for any length of time. This is especially true with such batteries as zinc-air and lithium batteries which have very high energy densities, but which can only supply current at a fraction of the level normally required to operate the vibrator 34.

As a result, the selective call receiver utilizing the alerting system in accordance with the preferred embodiment of the present invention includes a second energy source, or battery 44 which is preferably a secondary, or rechargeable device, such as a nickel cadmium battery to provide the energy to drive the vibrator 34. While a button cell nickel cadmium battery is capable of delivering high currents, the energy capacity of such a battery is relatively small when compared to a zinc-air or lithium primary battery system. As shown in FIG. 1A, the second battery 44 is coupled to the vibrator driver 32 to provide the energy to drive the vibrator 34. A charging circuit 36 has an output coupled to the second battery 44 supply terminal and an input coupled to the output of the voltage multiplier 30, which is required because both the first, or primary, battery 26A and the second, or secondary, battery 44 have substantially the same terminal voltages, on the order of from 1 to 1.5 volts. A second input to the charging circuit 36 is provided from the controller/decoder 16 which controls the charging of the secondary battery 44, as will be described below.

The charging circuit utilized in the preferred embodiment of the present invention includes a resistor 42 which couples to the voltage multiplier 30 output and is utilized to limit the charging current to a value suitable for charging, which for a button cell nickel cadmium battery having a battery capacity of 11 mA-Hr (milliampere-hours) would be on the order of 1.1 milliamperes. While a resistor is shown, it will be appreciated that a thermister can also be used which would vary the charging current as the temperature changes, thereby insuring the proper charging current as temperature varies. The collector of a transistor 40 is coupled to the resistor 42, the base is coupled to the controller/decoder 16 and the emitter is coupled to the secondary battery 44. Transistor 40 functions as a switch to control the charging of the secondary battery 44 from the primary battery 26A. It will be appreciated that other devices such as CMOS transmission gates and reed relays could provide the switching function as well. The cathode of a zener diode 38 is coupled to the emitter of the transistor 40 and to the positive battery terminal of the secondary battery 44, while the anode is coupled to ground. Zener diode 38 is selected to conduct at approximately the maximum battery terminal voltage, thereby limiting the energy provided to the battery 44 during charging to prevent overcharging of the battery.

In summary, the alerting system for a communication receiver in accordance with the present invention includes a primary battery for supplying energy at a first supply rate to a receiver which is used to receive transmitted selective call message signals. A decoder is coupled to the primary battery and decodes the received selective call message signals and generates an alert signal output. A secondary battery, or power source which is capable of being charged supplies energy at a second supply rate to an annunciator, such as a vibrator in response to the alert signal output to provide a sensible alert. A charging means is coupled to the primary battery and is responsive to the sensible alert being generated, for charging the secondary battery from the primary battery to replenish the energy consumed during the generation of the sensible alert.

Reference is directed to FIG. 1B which shows an alternate embodiment of the selective call communication receiver utilized in accordance with the present invention. The description provided for FIG. 1A above applies to the majority of the receiver shown in FIG. 1B. Unlike the receiver of FIG. 1A which has a voltage multiplier 30, no voltage multiplier is provided in the circuit of FIG. 1B since the battery 26B is preferably a lithium, or other multiple cell battery providing at least twice the battery voltage of a single cell battery. The battery 26B couples directly to the transducer driver, to the controller/decoder 16, and to the input of the charger circuit 36. In addition, the battery 26B couples to the input of a voltage regulator 50 which regulates the voltage to a lower level suitable for powering the receiver 14 through the power switch 28. As in the circuit of FIG. 1A, the circuit of FIG. 1B supplies power for operation of the vibrator 34 from the secondary battery 44. The secondary battery 44 is then recharged from the primary battery 26B, as will be described below.

Figure 2:
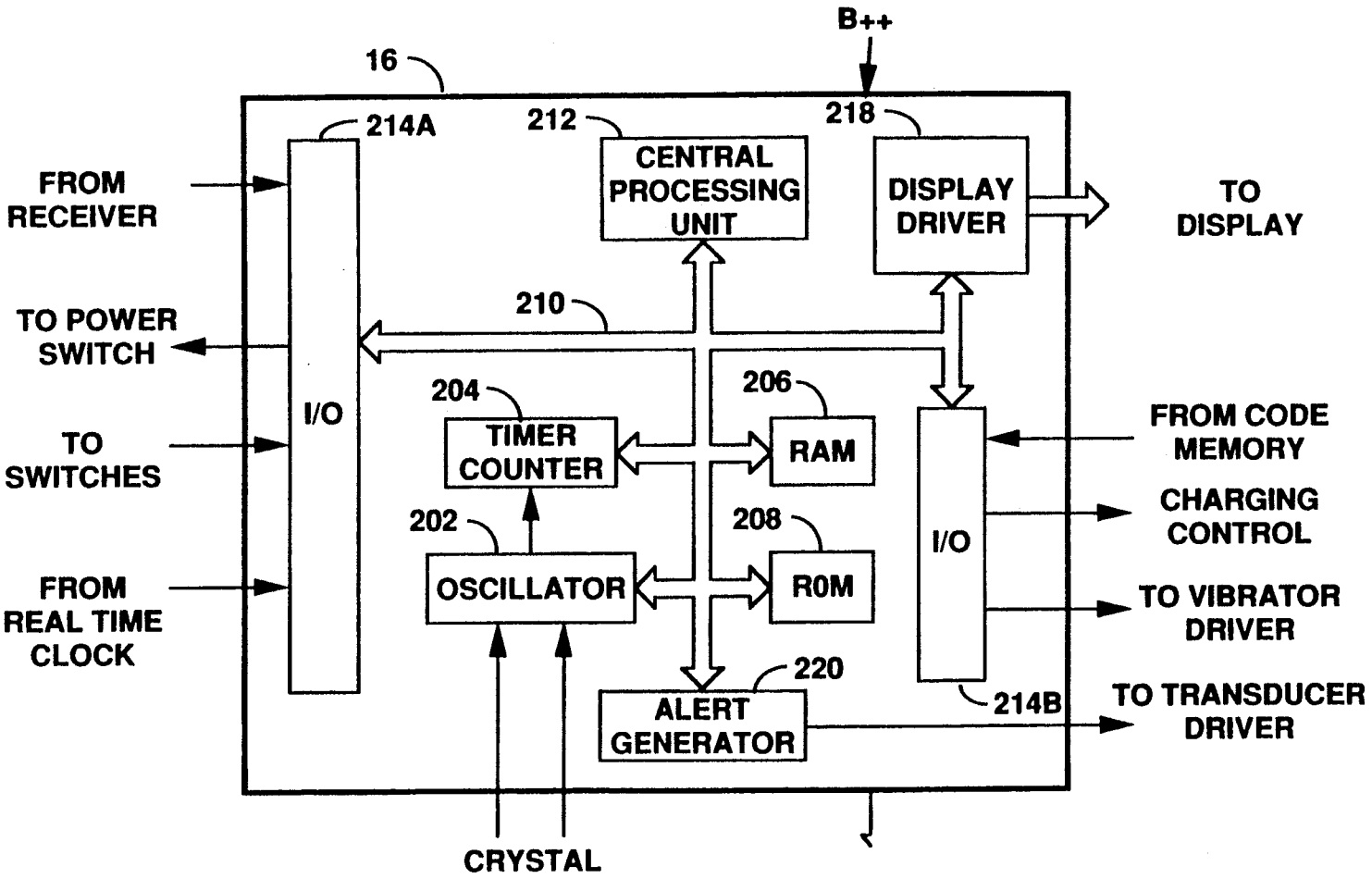
FIG. 2 is an electrical block diagram of a microcomputer utilized in the selective call receiver of FIGS. 1A and 1B.

The controller/decoder 16 of FIGS. 1A and 1B can be constructed utilizing a microcomputer as shown in FIG. 2. FIG. 2 is an electrical block diagram of the microcomputer utilized in the selective call receiver of FIGS. 1A and 1B. As shown, the microcomputer 16 is preferably a version of the MC68HC05 microcomputer manufactured by Motorola, Inc. which includes an on-board display driver. The microcomputer 16 includes an oscillator 202 which generates the timing signals utilized in the operation of the microcomputer. A crystal, or crystal oscillator (not shown) is coupled to the inputs of the oscillator 202 to provide a reference signal for establishing the microcomputer timing. A timer/counter 204 couples to the oscillator 202 and provides programmable timing functions which are utilized in controlling the operation of the receiver. A RAM (random access memory) 206 is utilized to store variables derived during processing, as well as to provide storage of message information which is received during normal operation. A ROM (read only memory) 208 stores the subroutines which control the operation of the receiver, as will be described in further detail below. It will be appreciated that in many microcomputer implementations, the PROM memory area can be provided by an EEPROM (electrically eraseable programmable read only memory). The oscillator 202, timer/counter 204, RAM 206 and ROM 208 couple through the address/data/control bus 210 to the central processing unit (CPU) 212 which performs the instructions and controls the operations of the microcomputer 16.

The demodulated data from the receiver is coupled into the microcomputer 16 through input/output (I/O) port 214A. The demodulated data is processed by the CPU 212, and when the received address is the same as an address stored in the code memory which is coupled into the microcomputer 16 through I/O port 214B, the message is received and stored in RAM 206. Recovery of the stored message is provided by the switches which are coupled to I/O port 214A. The CPU 212 recovers the message from RAM 206 and directs the information over the data bus 210 to the display driver 218 which processes the information and formats the information for display by a display such as an LCD (liquid crystal display). At the time the message is received, an alert signal is generated which can be routed through the data bus 210 to the alert generator 220 which generates the alert signal which is coupled to the audio transducer driver as described above.

Figure 3A:
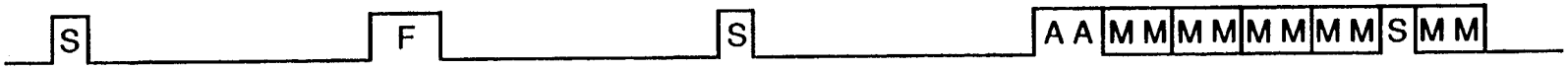
FIGS. 3A and 3B are timing diagrams showing representative operations of the battery saving and charging functions for the selective call receivers of FIGS. 1A and 1B.

Battery saver operation is control by the CPU 212 with battery saving signals which are directed over the data bus 210 to the I/O port 214A which couples to the power switch. As shown in FIG. 3A, a typical battery saving sequence for a paging signaling format, such as the POCSAG signaling format, is shown. Power is periodically supplied to the receiver during the synchronization time interval (S) to enable the decoder to obtain or maintain synchronization with the received signal, and during the assigned frame (F) to enable the receiver to receive address and message information directed thereto. As shown in FIG. 3A, power is supplied to the receiver during two synchronization intervals (S) and two frame intervals (F). During the second frame interval, an address is detected which indicates that the message information following is intended for the receiver. During the message time intervals (M), the supply of power is maintained to the receiver to enable reception of the message information. Following the receipt of the message, the normal battery saving cadence is utilized.

Figure 3B:
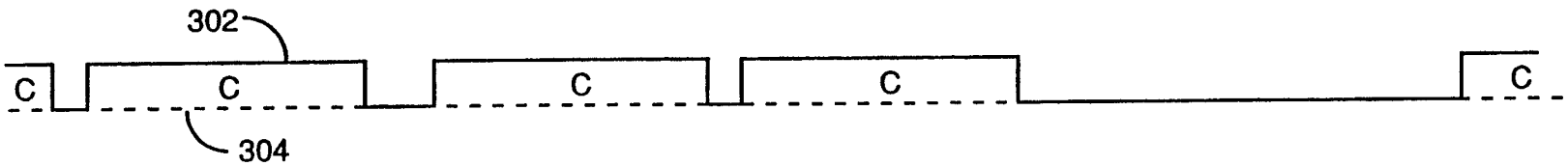

When the silent mode of operation is selected, the alert signal is directed over the data bus 210 to the I/O port 214B which couples to the vibrator driver. The CPU monitors the time during which the vibrator is active, as will be described below, and in response to the vibrator having been activated, a charging control signal is generated which is directed over data bus 210 to I/O port 214B to provide the charging control signal to the charging circuit, as described above. As shown in FIG. 3B, the secondary battery is charged subsequent to the vibrator being activated. In the preferred embodiment of the present invention, the charging control signal 302 goes high only during those time periods (C) when the receiver is not active. By not charging the secondary battery during the receiver "on" times, the power required to be delivered from the multiplier is minimized which results in improved multiplier efficiency, thereby improving the battery life of the primary battery. After the secondary battery has been charged, the charging control signal remains low 304, inhibiting any further charging of the battery by the battery charging circuit.

Figure 4A:
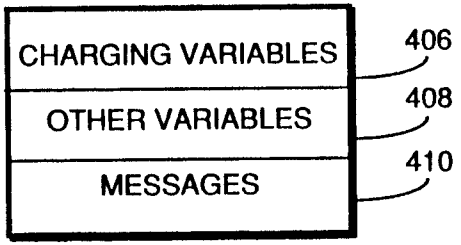
FIGS. 4A–4D are memory maps showing representative allocation of memory areas for the microcomputer based selective call receivers of FIGS. 1A and 1B.
Figure 4B:
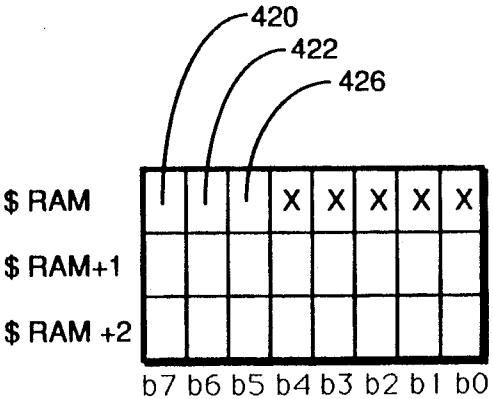

FIGS. 4A-4D are memory maps showing representative allocation of memory areas for the microcomputer based selective call receivers of FIGS. 1A and 1B. In particular, FIG. 4A shows the representative memory map 402 for RAM 206 which provides storage of the charging variables 406 to be described below, other program variables 408 used in control of the receiver, and message information 410. Three RAM bytes, as shown in FIG. 4B, are allocated in the preferred embodiment of the present invention for the charging variables 406. The first RAM byte identified $RAM utilizes three bits, or flags, identified as CHG_HALT 420 which is set when the charging cycle is interrupted, CNTR_ACT 422 which is set when the charge timer is active and cleared when the charge timer is inactive, and CHG_RQST 424 which is set when a charge request is made and is cleared when the charging system is inactive. The second RAM byte identified as $RAM+1 functions as the charge counter (CHARGE_CNTR) which holds the value of the charging time in charge counter units, and which is periodically decremented during charging. The last RAM byte identified as $RAM+2 functions as the charge timer (CHARGE_TMR) which identifies the charge timing resolution, which is the time interval between decrementing of the charge counter.

The total battery charging time is established by the combined values of the CHARGE_TMR byte and the CHARGE_CNTR byte. The CHARGE_TMR stores a value equal to the CHARGE_RESOLUTION which may be, for example, a value of 60, which when decremented at 1 second increments, results in a charge timer time of 1 minute. The CHARGE_CNTR stores a value equal to the time required to recharge the secondary battery which, for example, is a value of 35. The CHARGE_CNTR is decremented each time the CHARGE_TMR rolls over, as will be described below, resulting in a total charging time of 35 minutes. It will be appreciated that the values selected for the CHARGE_RESOLUTION and the CHARGE_CNTR for any operation of the alerting device is a function of the energy consumed per second of alert device operating time and the energy delivered per minute of charging. Thus, when a vibrator consumes power at 110 ma for 21 seconds, it would take 35 minutes at 1.1 ma to replace the energy consumed. The factor used to determine charge time versus discharge time becomes 35 minutes=21 seconds, or for every 21 seconds of operation is provided, 35 minutes of recharging is required. It will be appreciated that the charging factors will vary according to the current drain and time of consumption and the charging current and time for charge.

FIG. 4A further shows the representative memory map 404 for ROM 208. ROM 208, as shown, provides for the storage of the battery saving routines 412 and decoding routines 414 associated with the selective call signaling format in use in the receiver. The alerting subroutines 416 provide for the generation of different alerts depending upon the address received. The charging subroutines 418 provide control of the charging of the secondary battery as will be described below. It will be appreciated that other routines used to control the operation of the selective call receiver will be stored in ROM 208 as well and that the subroutines identified are done so for example only.

Figure 4D:
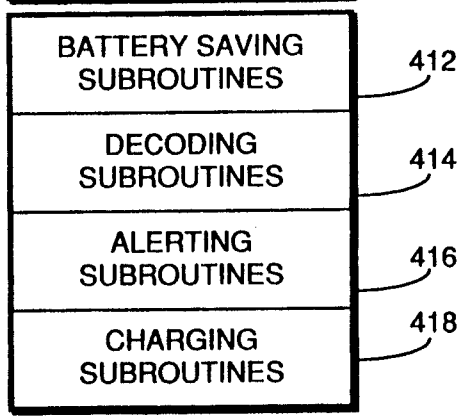
Figure 4D:
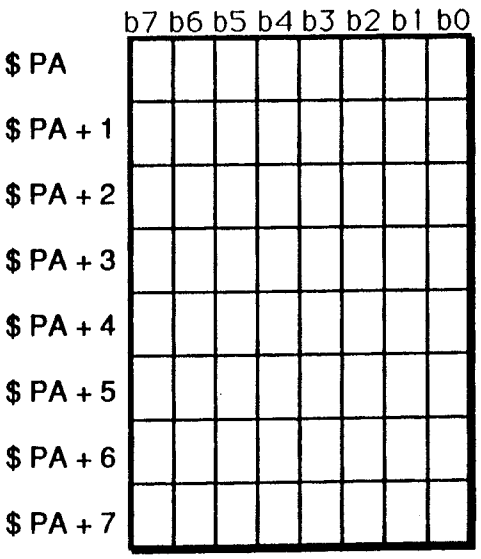
Figure 4C:
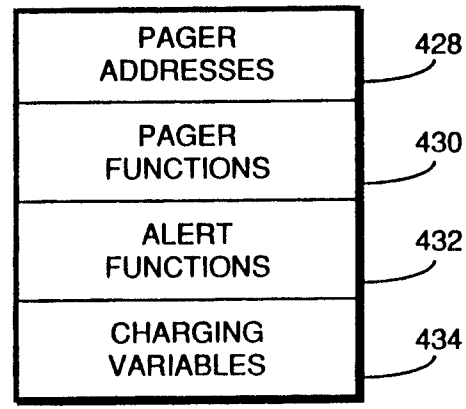

FIG. 4C shows the representative memory map 426 for the code plug, or code memory, 18. The code memory 18, as shown, provides for the storage of addresses 428 assigned to the receiver; the functions 430, such as tone only, numeric or alphanumeric, which are assigned to the stored addresses; the alert functions 432, such as indicating alerting cadences; and the preprogrammed charging variables 434, as will be described below.

FIG. 4D indicates that eight bytes of information are preprogrammed into the charging variables 434 section of the code memory. The first byte identified $PA holds the initial charge (INITIAL_CHARGE) value which is in charge counter units, and which is provided to enable an initial charge be provided whenever the microcomputer is reset. The second byte identified as $PA+1 hold the charge-resolution (CHARGE_RESOLUTION) value which is loaded into the charge timer, and which identifies the time between charge counter decrements, typically a value between one and five minutes. The third byte identified as $PA+2 holds the charge delay (CHARGE_DELAY) which is a value in charge timer units which indicates the delay before applying an initial charge to a battery. This delay allows the radio to be tested prior to the battery being charged in the factory. The fourth byte identified as $PA+3 holds the leakage charge requirement (LEAKAGE_CHARGE) which is a value in charge timer units and represents the charge that must be replaced due to leakage currents in the battery. The fifth byte identified as $PA+4 holds the maximum charge (MAX_CHARGE) value in charge counter units, which represents the maximum value for the charge counter before the charging circuit is engaged. The sixth byte identified as $PA+5 holds the minimum charging time (SHORT_ALERT_CHARGE) value which is in charge counter units and represents the energy which must be replaced for a two second or less alert time. The seventh byte identified as $PA+6 holds the nominal charging time (MED_ALERT_CHARGE) value which is in charge counter units and represents the energy which must be replaced for an alert falling between two seconds and eight seconds. The eighth byte identified as $PA+7 holds the maximum charging time (MAX_ALERT_CHARGE) value which is in charge counter units and represents the energy which must be replaced for an alert greater than eight seconds in duration.

In summary, the preprogrammed charging variables enable the charging times required for charging the secondary battery to be adjusted for different alert time intervals and for different discharge rates when the vibrator is operational.

FIGS. 5A-5G are flow charts describing the operation of the microcomputer based selective call receivers of FIGS. 1A and 1B which utilize the alerting system in accordance with the preferred embodiment of the present invention. In particular, referring to FIG. 5A, when power for the selective call receiver is turned on, at step 502, the initialization subroutine is executed, at step 504, to prepare the selective call receiver for message reception. The program then advances to step 506 where the CPU executes the initial charge setup subroutine which initializes the parameters utilized in the secondary battery charging circuit operation. Following the execution of the initialization subroutines, the receiver is in the battery saving "sleep" state. The program advances to step 508 where the program is temporarily suspended until a run time instruction is generated by the signal processor timer, at step 532, to be described below.

When the instruction to run is provided, at step 508, the program advances to step 510 where the CPU executes the page processing subroutine, which awakes the receiver from the battery saving "sleep" state to enable the reception and processing of any transmitted messages. The program then advances to step 512 where the CPU executes the system timer update subroutine which updates the operational system timers. The program then advances to step 514 where the CPU executes the charge time update subroutine which will be described below. The program then advances to step 516 where the CPU executes the alert processing subroutine which processes any alerts which are the result of receiving an address which is intended for the receiver. The program then advances to step 518 where the CPU executes the input processing subroutine which processes any user initiated control switch operations, such as a request to read the message, or to reset the alert being generated. The program then advances to step 520 where the CPU executes the daily charge subroutine which initiates the charging the secondary battery when charging of the battery has not otherwise been initiated by the operation of the vibrator function. The program then returns to step 508 to await for the next run time instruction from the signal processor timer.

Figure 5A:
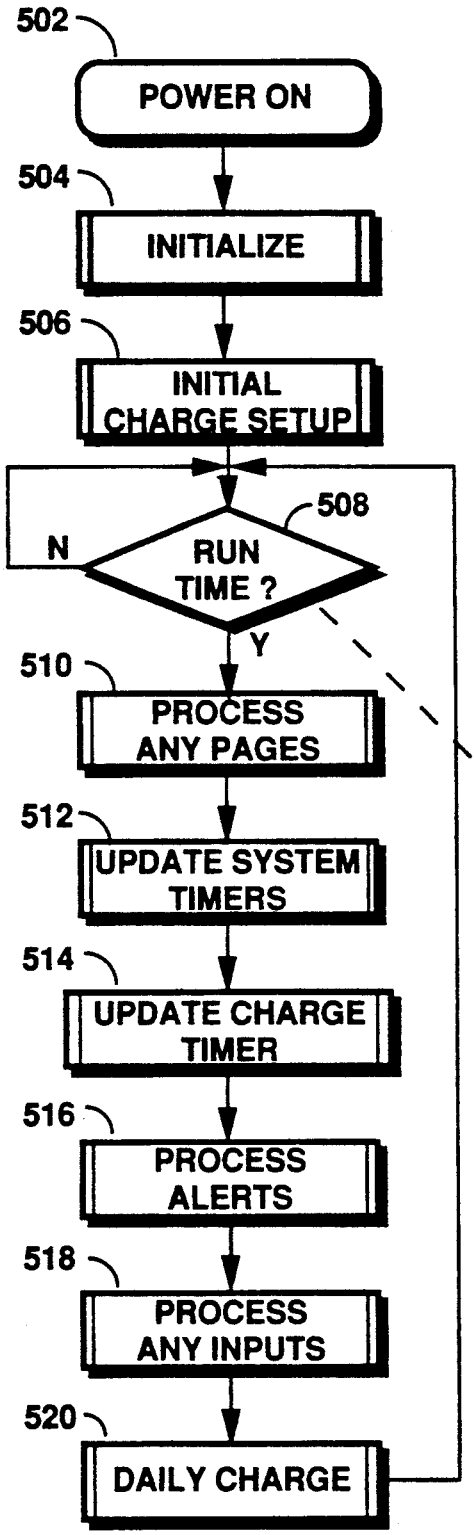
FIGS. 5A–5G are flow charts describing the operation of the microcomputer based selective call receivers of FIGS. 1A and 1B which utilize the alerting system in accordance with the preferred embodiment of the present invention.
Figure 5B:
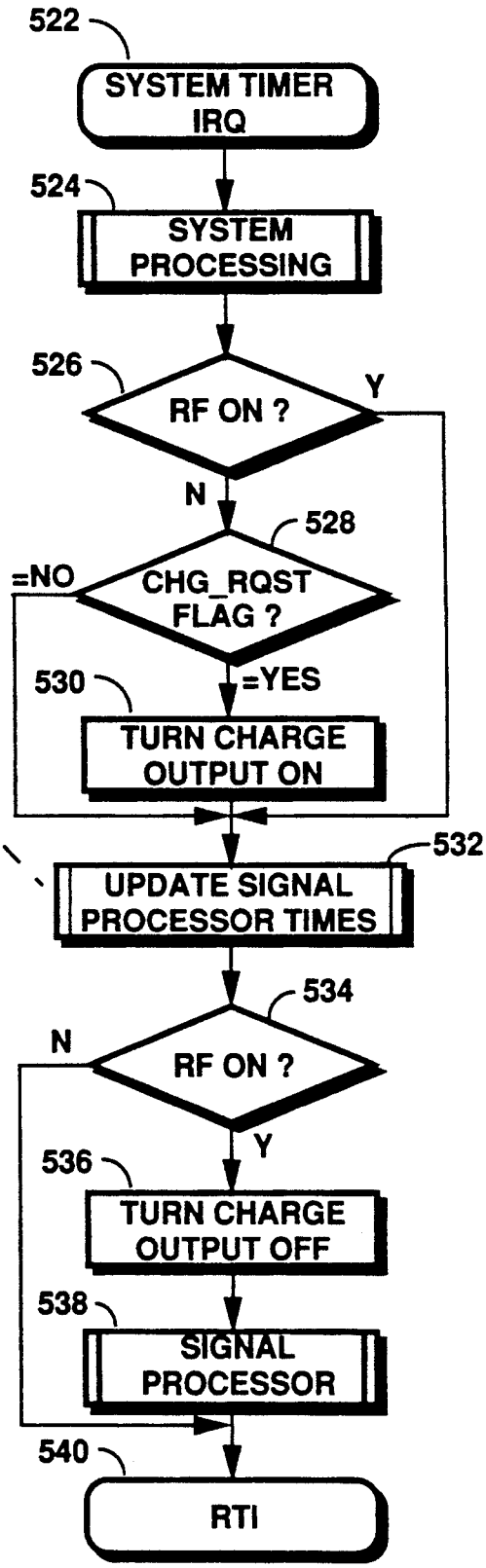

As described above, the program execution described in FIG. 5A is triggered for the program being executed in FIG. 5B. Each time a system timer interrupt is generated, at step 522, the program advances to step 524 where the CPU executes the system processing subroutine. The program then advances to step 526 where the CPU checks whether the battery saver signal output is active turning the receiver on. When the receiver is not turned on, the program advances to step 530 where the CPU evaluates the current CHG_RQST flag, and when the value is set (=YES), the CPU turns on the charge control output which generates the charging control signal at the charging control, or CHARGE output. When the current CHG_RQST flag is evaluated and the value is not set (=NO), at step 528, or the CPU has turned on the receiver, at step 526, the program advances to step 532 where the CPU executes the signal processor timer update subroutine. The signal processor timer is then clocked and the value evaluated to determine if any processes are to be activated, such as the run time routine beginning at step 508. The program then advances to step 534 where the CPU checks whether the receiver is turned on. When the receiver is turned on, the program advances to step 536 where the CPU turns off the charge control output which suspends the generation of the charging control signal at the CHARGE output. When the charging is suspended at step 536, the program advances to step 538 where the CPU executes the signal processor subroutine to begin the processing of any received signals. It will be appreciated that the particular signal processing subroutine executed is a function of the particular signaling format employed in the transmission of address and message information. Following the execution of the signal processor subroutine, or when the CPU has determined that the receiver was not turned on at step 534, the program returns from the interrupt, at step 540, to await the next system interrupt request.

Figure 5C:
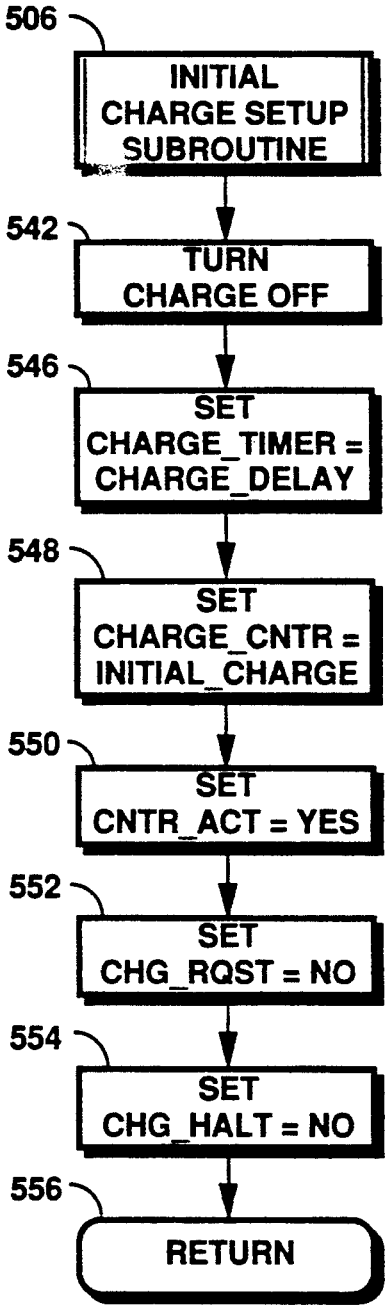

The initial charge setup subroutine is shown in FIG. 5C. When program control advances to step 506 in FIG. 5A, the program advances to step 542, as shown in FIG. 5C, where the CPU turns off the charger control output. The program then advances to step 546 where the CPU sets the value of the CHARGE_TIMER memory byte to the CHARGE_DELAY value stored in the code memory. The program then advances to step 548 where the CPU sets the value of the CHARGE_CNTR to the INITIAL_CHARGE value stored in the code memory. The program then advances to step 550 where the CPU sets the CNTR_ACT flag to =YES, indicating that the charge timer is active. The program then advances to step 552 where the CPU set the value of the CHG_RQST flag to =NO, indicating charging of the secondary battery is not requested at this time. The program then advances to step 554 where the CPU sets the value of the CHG_HALT flag to =NO, indicating charging has not been interrupted by any other process. The program then advances to step 556 which returns to program to step 508 of FIG. 5A to await the next run time instruction from the signal processor timer.

Figure 5D:
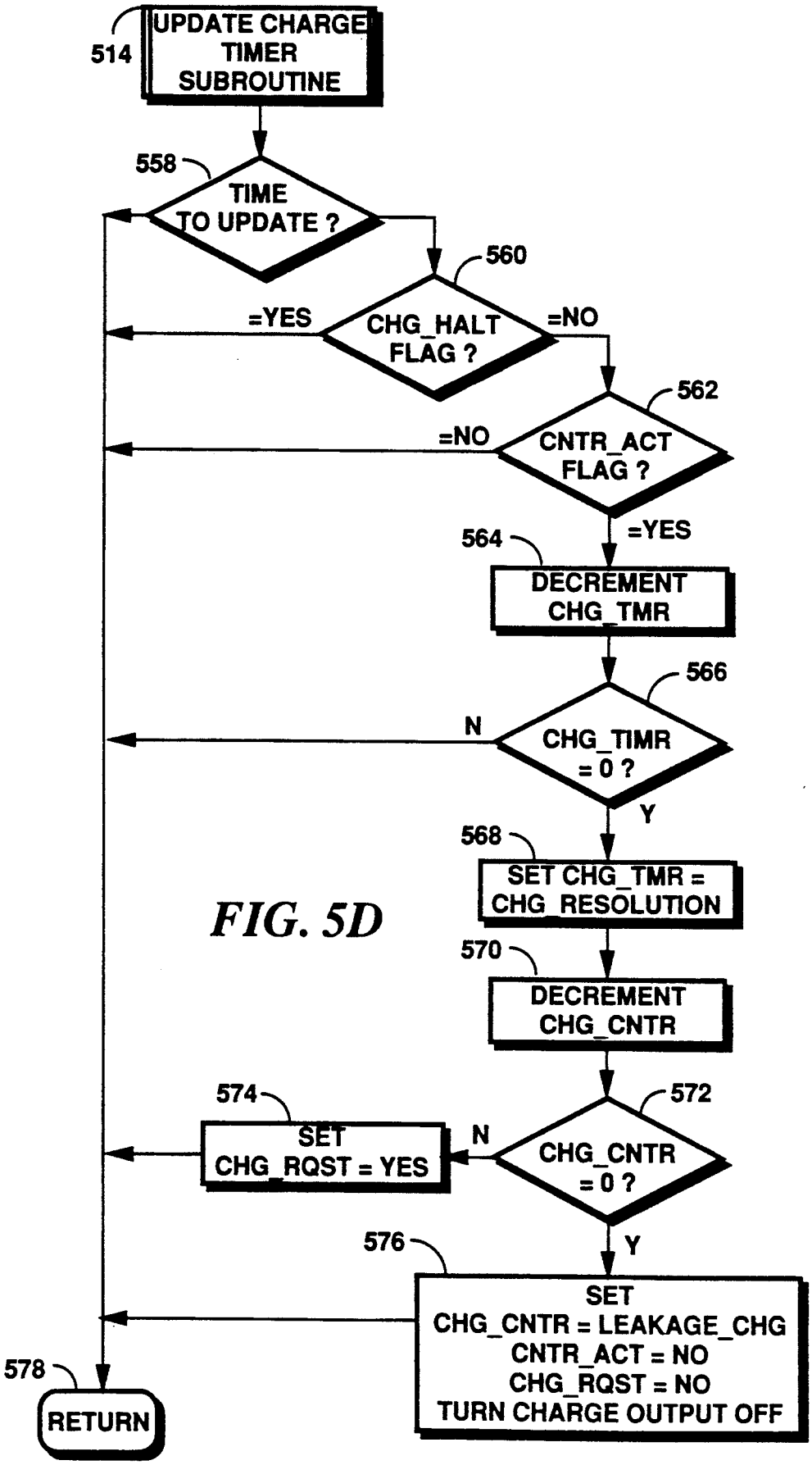

The update charge timer subroutine is shown in FIG. 5D. When program control advances to step 514 in FIG. 5A, the program advances to step 558, as shown in FIG. 5D, where the CPU evaluates whether a clock interrupt has been generated by the real time clock or other clock timing source indicating that it is time to update the charge timer, otherwise the program advances to step 578, returning the program to step 516. The clock interrupt is generated at regular real time clock intervals, such as every second, and is used to decrement the timer value stored in the CHARGE_TMR byte, which as previously described is set to typically one minute or five minute intervals, although it will be appreciated that other interval values can be set as well depending upon the length of time that charging is required. When a clock interrupt is generated, the program advances to step 560 where the CPU evaluates the contents of the CHG_HALT flag, and when the flag is set (=YES) indicating that charging has been interrupted, the program advances to step 578, returning the program to step 516, otherwise the program advances to step 562. At program step 562, the CPU evaluates the contents of the CNTR_ACT flag, and when the flag is set (=YES) indicating that charging of the secondary battery is still required, the program advances to step 564, otherwise the program advances to step 578, returning the program to step 516. At program step 564, the CPU decrements the CHG_TMR byte value by one count, and the program advances to step 566 where the CPU evaluates whether the CHG_TMR byte value is equal to zero, and if not, the program advances to step 578, returning the program to step 516. When the CHG_TMR byte value is equal to zero, the program advances to step 568 where the CPU resets the CHG_TMR byte value to the CHG_RESOLUTION value stored in the code memory. The program then advances to step 570 where the CPU decrements the CHG_CNTR byte value, after which the program advances to step 572 where the CPU evaluates whether the CHG_CNTR byte value is equal to zero indicating that charging is complete, and when charging is not complete, the program advances to step 574 where the CPU sets the CHG_RQST flag value (=YES) indicating that charging of the secondary battery is still requested, after which the program advances to step 578, returning the program to step 516. When the CHG_CNTR value is equal to zero, the program advances to step 576 where the CPU sets the CHG_CNTR byte value to the LEAKAGE_CHG value stored in the code memory, resets the CNTR_ACT flag value (=NO), resets the CHG_RQST flag value (=NO), and turns off the CHARGE output. The program then advances to step 578, returning the program to step 516.

Figure 5E:
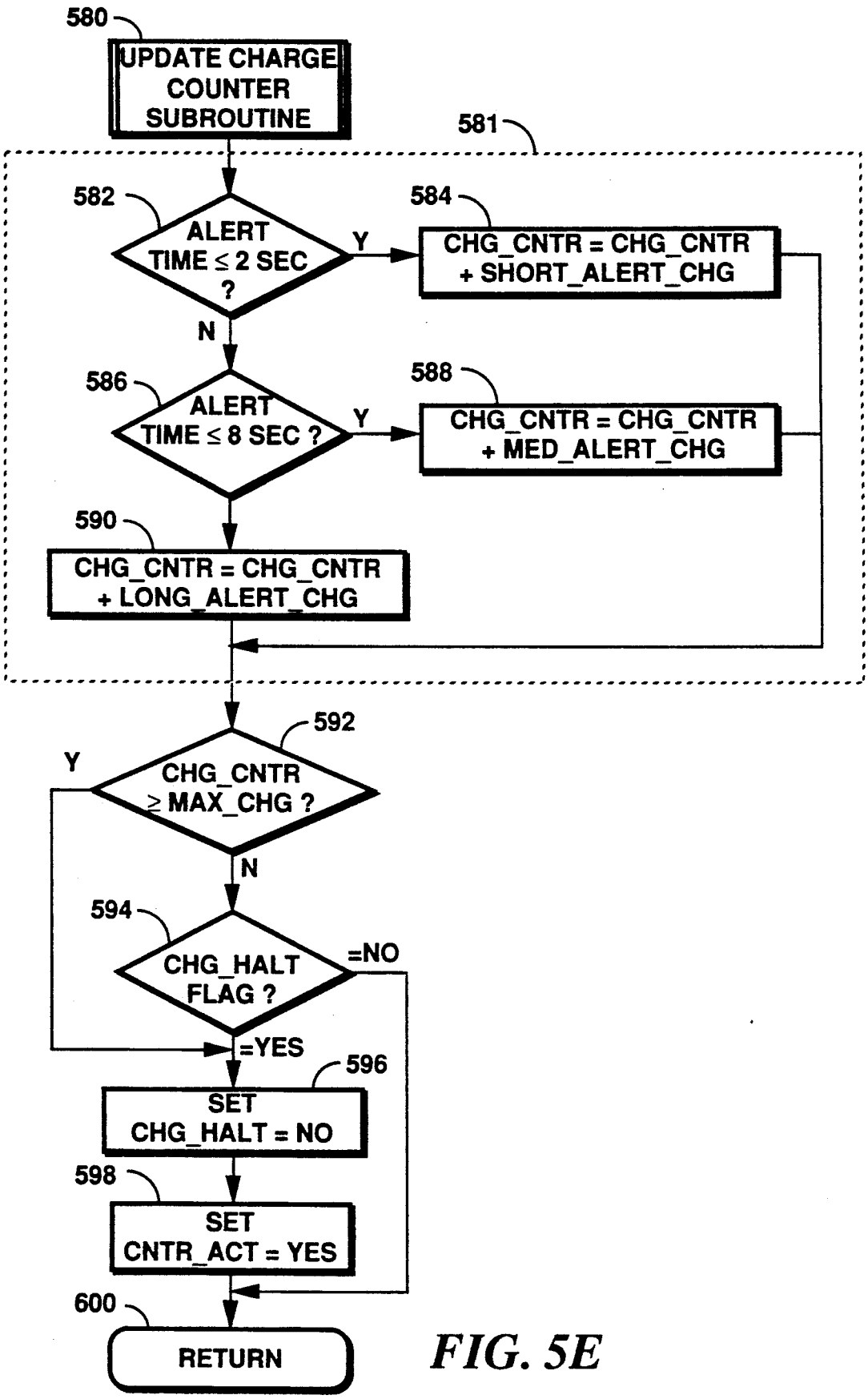

The charge counter update subroutine is shown in FIG. 5E and the subroutine is invoked each time the vibrator is activated which normally occurs during steps 516 or 518 of FIG. 5A. Returning to FIG. 5E, when the vibrator is activated by the microcomputer, the CPU monitors the time during which the vibrator is active. In this manner, the time required to recharge the secondary battery can be determined. When the vibrator alert has been reset, the program advances to step 582 where the CPU evaluates whether the alert time is less than or equal to two seconds. When the alert time is less than or equal to two seconds, the program advances to step 584 to update the CHG_CNTR value by adding the SHORT_ALERT_CHG value stored in the code memory to the current CHG_CNTR value stored in the CHG_CNTR byte, after which the program advances to step 592. When the alert time is greater than two seconds, the program advances to step 586 where the CPU evaluates whether the alert time is less than or equal to eight seconds. When the alert time is less than or equal to eight seconds, the program advances to step 588 to update the CHG_CNTR value by adding the MED_ALERT_CHG value stored in the code memory to the current CHG_CNTR value stored in the CHG_CNTR byte, after which the program advances to step 592. When the alert time is greater than eight seconds, the program advances to step 590 to update the CHG_CNTR value by adding the LONG_ALERT_CHG value stored in the code memory to the current CHG_CNTR value stored in the CHG_CNTR byte, after which the program advances to step 592.

At program step 592, the CPU evaluates whether the CHG_CNTR value is greater than or equal to the MAX_CHG value stored in the code memory, and if not, the program advances to step 594 where the CPU evaluates the CHG_HALT flag value. When the CHG_HALT flag value is set (=YES), or the CHG_CNTR value is greater than the MAX_CHG value, the program advances to step 596 where the CPU resets the CHG_HALT flag value (=NO), indicating the return to the charging routine. The program then advances to step 598 where the CPU sets the CNTR_ACT flag (=YES) restarting the charge timer. When the CNTR_ACT flag has been set, or when the CHG_HALT flag value is determined to be reset (=NO) at program step 594, the program then advances to step 600 to return to the next program step from which the charge counter update subroutine was invoked.

Figure 5F:
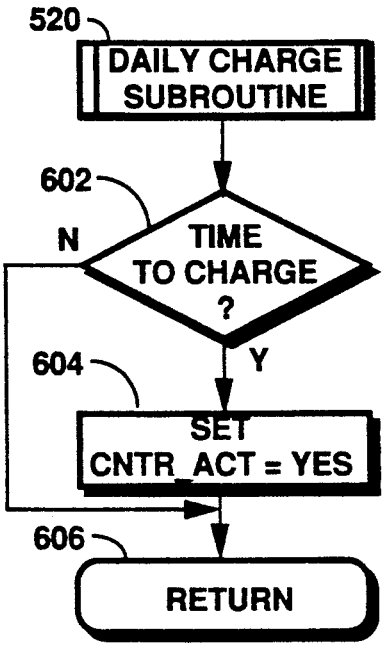

The daily charge subroutine is shown in FIG. 5F. When program control advances to step 520 in FIG. 5A, the program advances to step 602, as shown in FIG. 5F where the CPU evaluates whether a clock interrupt has been generated indicating that it is time to charge the secondary battery. When it is time to charge, the program advances to step 604 where the CPU sets the CNTR_ACT flag (=YES). When the CNTR_ACT flag value has been set, or when the CPU has determined it is not time to charge at step 602, the program advances to step 606 to return the program to step 508 of FIG. 5A to await the next run time instruction from the signal processor timer.

Figure 5G:
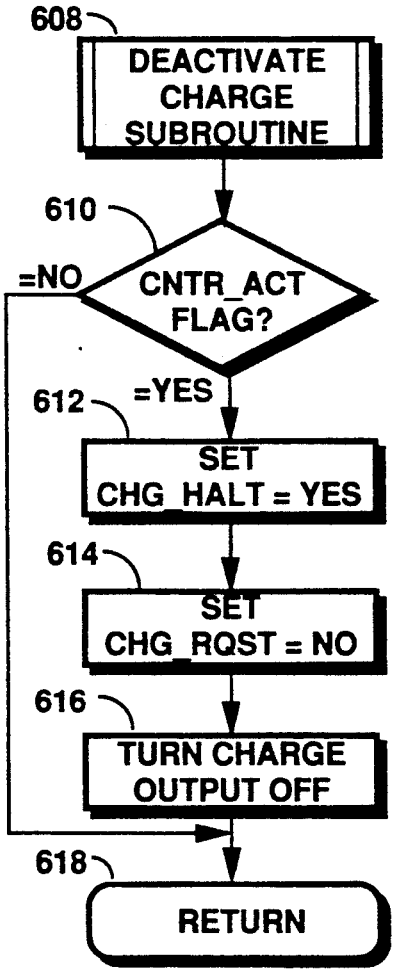

The deactivate charge subroutine shown in FIG. 5G is invoked any time the alerting device operation is requested, such as during steps 510, 516 and 518 of FIG. 5A. When the deactivate charge subroutine is invoked at step 608, the program advances to step 610 where the CPU evaluates whether the CNTR_ACT flag is set (=YES), at which time the program advances to step 612 where the CPU sets the CHG_HALT flag value (=YES). The program then advances to step 614 where the CPU resets the CHG_RQST flag value (=NO). The program then advances to step 616 where the CPU turns off the CHARGE output suspending the generation of the charging control signal. When the charging of the secondary battery is suspended, or when the CNTR_ACT flag is not set, at step 610, the program advances to step 618, returning to the next program step from which the deactivate charge subroutine was invoked.

An alerting system for a selective call receiver has been described which enables the use of a tactile alert device in a receiver powered from a battery which cannot regularly supply the current necessary to drive the tactile alerting device or any other alerting device which may be utilized. A secondary battery, capable of supplying the current is coupled to the tactile alerting device to provide power to the tactile alerting device during operation. The secondary battery is then recharged from the battery supplying power to the receiver, thereby allowing a secondary battery having only a limited energy content to be utilized to supply power to the tactile alerting device.

We claim:

1. An alerting system for a communication receiver including a battery for supplying energy at a first supply rate and a receiver coupled thereto for receiving transmitted selective call message signals, said alerting system comprising:

decoder means, coupled to the battery, for decoding the received selective call message signals and for generating an alert signal output in response thereto;

a power source, capable of being charged, for supplying energy at a second supply rate;

annunciator means, coupled to said power source, and responsive to the alert signal output for providing a sensible alert, said annunciator means consuming energy at the second supply rate when providing the sensible alert; and charging means, coupled to the battery and responsive to the sensible alert being generated, for charging said power source from the battery to replenish the energy consumed during the generation of the sensible alert.

2. The alerting system according to claim 1, wherein the second supply rate is substantially greater than the first supply rate.

3. The alerting system according to claim 1, wherein said charging means comprises:

controller means, responsive to said decoder means for generating a charge enable signal in response to the sensible alert being generated; and switching means, coupled to the battery and to said power source, and responsive to the charge enable signal, for controlling the charging of said power source from the battery.

4. The alerting system according to claim 3, wherein said controller means generates the charge enable signal following the generation of the sensible alert.

5. The alerting system according to claim 3, wherein said switching means further includes current controlling means for controlling the rate of charging of said power source from the battery.

6. The alerting system according to claim 5, wherein the rate of charging is substantially less than the first supply rate.

7. The alerting system according to claim 3, wherein said switching means further includes energy limiting means coupled to said power source for limiting the amount of energy supplied in said power source during charging.

8. The alerting system according to claim 1 further comprising:

means for determining a value of the energy consumed during the generation of the sensible alert; and accumulating means, responsive to said determining means, for accumulating a total value of the energy consumed by said annunciator means during a first and any subsequently generated sensible alerts, wherein said charging means being further responsive to said accumulating means for effecting the charging of said power source when the value of the energy consumed exceeds a predetermined energy consumption value.

9. A communication receiver comprising:

a battery for supplying energy at a first supply rate;

a receiver, coupled to said battery, for receiving transmitted selective call message signals;

decoder means, coupled to said battery, for decoding the received selective call message signals and for generating an alert signal output in response thereto;

a power source, capable of being charged, for supplying energy at a second supply rate;

annunciator means, coupled to said power source, and responsive to the alert signal output for providing a sensible alert, said annunciator means consuming energy at the second supply rate when providing the sensible alert; and charging means, coupled to said battery and responsive to the sensible alert being generated, for charging said power source from said battery to replenish the energy consumed during the generation of the sensible alert.

10. The communication receiver according to claim 9, wherein the second supply rate is substantially greater than the first supply rate.

11. The alerting system according to claim 9 further comprising:

means for determining a value of the energy consumed during the generation of the sensible alert; and accumulating means, responsive to said determining means, for accumulating a total value of the energy consumed by said annunciator means during a first and any subsequently generated sensible alerts, wherein said charging means being further responsive to said accumulating means for effecting the charging of said power source when the value of the energy consumed exceeds a predetermined energy consumption value.

12. The communication receiver according to claim 9, further comprising:

controller means, responsive to said decoder means for generating a battery saving signal; and a power switch, responsive to said battery saving signal, for controlling the supply of power to said receiver.

13. The communication receiver according to claim 12, wherein said controller means comprises a microcomputer.

14. The communication receiver according to claim 12, wherein said controller means further generates a charge enable signal in response to the sensible alert being generated, and wherein said charging means comprises switching means, coupled to said battery and to said power source, and responsive to the charge enable signal, for controlling the charging of said power source from said battery.

15. The communication receiver according to claim 14, wherein said controller means generates the charge enable signal following the generation of the sensible alert.

16. The communication receiver according to claim 14, wherein said controller means inhibits the generation of the charge enable signal when the battery saver signal is generated.

17. The communication receiver according to claim 14, wherein said switching means further includes current controlling means for controlling the rate of charging of said power source from said battery.

18. The communication receiver according to claim 14, wherein said switching means further includes energy limiting means coupled to said power source for limiting the amount of energy supplied in said power source during charging.

19. The communication receiver according to claim 14, wherein said battery terminal voltage is substantially greater than said power source terminal voltage, and wherein said switching means controls the charging of said power source directly from said battery.

20. The communication receiver according to claim 14, wherein said power source has a terminal voltage which is substantially the same as generated by said battery, and wherein said alerting system further comprises:

voltage multiplier means, coupled to said battery and to said switching means, for multiplying said battery terminal voltage supplied to said switching means for enabling the charging of said power source.

* * * * *